United States Patent [19]

Meixner

[11] 4,331,861

[45] May 25, 1982

[54] POSITIVE TEMPERATURE COEFFICIENT (PTC) RESISTOR HEATING DEVICE

[75] Inventor: Hans Meixner, Haar, Fed. Rep. of Germany

[73] Assignee: Siemens Aktiengesellschaft, Berlin & Munich, Fed. Rep. of Germany

[21] Appl. No.: 181,188

[22] Filed: Aug. 25, 1980

[30] Foreign Application Priority Data

Sep. 28, 1979 [DE] Fed. Rep. of Germany ..... 2939470

[51] Int. Cl.[3] ..... H05B 3/10

[52] U.S. Cl. ..... 219/553; 219/505; 219/540; 219/541; 338/22 R

[58] Field of Search ..... 338/22 R, 22 SD, 225, 338/223, 224; 219/504, 505, 441, 523, 528, 530, 540, 541, 544, 552, 553

[56] References Cited

U.S. PATENT DOCUMENTS

| | | | |
|---|---|---|---|
| 2,278,072 | 3/1942 | Gould et al. | 338/22 R |
| 3,243,753 | 3/1966 | Kohler | 338/22 R X |
| 3,344,316 | 9/1967 | Stelmak | 338/22 R X |
| 3,401,318 | 9/1968 | Jensen | 338/22 R X |
| 3,940,591 | 2/1976 | Ting | 219/544 |
| 3,996,447 | 12/1976 | Bouffard et al. | 219/541 |
| 4,147,927 | 4/1979 | Pirotte | 219/541 |
| 4,177,375 | 12/1979 | Meixner | 219/441 |
| 4,223,208 | 9/1980 | Kleinschmidt et al. | 219/530 |
| 4,230,935 | 10/1980 | Meixner | 219/523 |

*Primary Examiner*—Volodymyr Y. Mayewsky

*Attorney, Agent, or Firm*—Hill, Van Santen, Steadman, Chiara & Simpson

[57] ABSTRACT

A heating device has a PTC resistor plate as the heating element and is covered with an insulating body. Between the heating element and the insulating body, on each of opposite surfaces of the heating element, ductile metal layers, preferably aluminum, are provided under a permanent pressure of at least $0.3\times10^8$ Pa, the layers being designed as current supply electrodes having electrical terminals. The resistor plate may advantageously have a surface roughness in the magnitude of 100 $\mu$m.

6 Claims, 3 Drawing Figures

POSITIVE TEMPERATURE COEFFICIENT (PTC) RESISTOR HEATING DEVICE

BACKGROUND OF THE INVENTION

1. Field of the Invention

The present invention relates to a heating device having a positive temperature coefficient (PTC) resistor plate as the heating element and having current supply electrodes and at least one insulating body, the individual portions of the device being held together by pressure.

2. Description of the Prior Art

A heating device having an optimized heating element consisting of PTC resistor material is known in the art, particularly from the German published application No. 27 43 880, corresponding to U.S. Pat. No. 4,177,375. The PTC resistor heating element, as essential features, has a thickness of only 0.5–2 mm given a specific electrical resistance of the PTC resistor material kept within a relatively narrow range, the PTC resistor material having, in addition, a Curie temperature which is at least 50° higher than the shutdown temperature provided for the heating device.

Particularly in the German published applications P No. 28 06 159, corresponding to U.S. Pat. No. 4,230,935 and P No. 28 16 076, corresponding to U.S. Pat. No. 4,223,208, measures for installing such a PTC resistor heating device are set forth in which the PTC resistor plate is held under pressure between the heat-dissipating plates.

In all previous instances, current supply electrodes have been provided for the current supply into the PTC resistor plate on the PTC resistor material itself. Surface metalizations of aluminum, of In-Ga-Ag multiple layers and, recently, also of enameling silver have been employed.

Wide areas of employment for heating devices having PTC resistor plates have been opened up. For the practical introduction of such heating devices, the decisive matter is the technical expense which is reflected in the price and which, for mass production, of course, is to be held to a minimum.

SUMMARY OF THE INVENTION

The object of the present invention is to provide a further simplification for heating devices having PTC resistor plates.

Given a heating device of the type generally set forth above, the above object is achieved, according to the present invention, in that a PTC resistor plate has surfaces which are free of metalization, in that laminae consisting of ductile metal are provided which are adjacent to the PTC resistor plate at both sides thereof and across the total surface under pressure of at least $0.3\times10^8$ Pa and which are designed as current supply electrodes having terminals.

In a particular embodiment, aluminum is employed for the laminae of ductile metal.

According to a particular feature of the invention, the PTC resistor plate has a surface roughness in the order of magnitude of 100 $\mu$m.

With the invention, a fundamentally different manner of current supply is provided than was previously provided for all technical employments. According to the invention, therefore, the problems which occurred in conjunction with metalizations of PTC resistor material due to the occurrence of barrier layers have also been solved.

In a heating device constructed in accordance with the invention, PTC resistor plates are employed which do not have metalization on the surfaces thereof whatsoever. Metal laminae of suitable form which are adjacent surface-wide to both sides of the PTC resistor plate serve as the supply electrodes. A ductile metal such as, for example, essentially unalloyed aluminum or lead, are employed for the laminae. Due to the pressure already provided in heating devices of the appertaining type when built in, the laminae consisting of ductile metal are pressed firmly against the surface of the PTC resistor plate in such a manner that, as has been demonstrated in experiments underlying the invention, a sufficient and permanently good contact occurs even for a heating element having a relatively high current flow.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
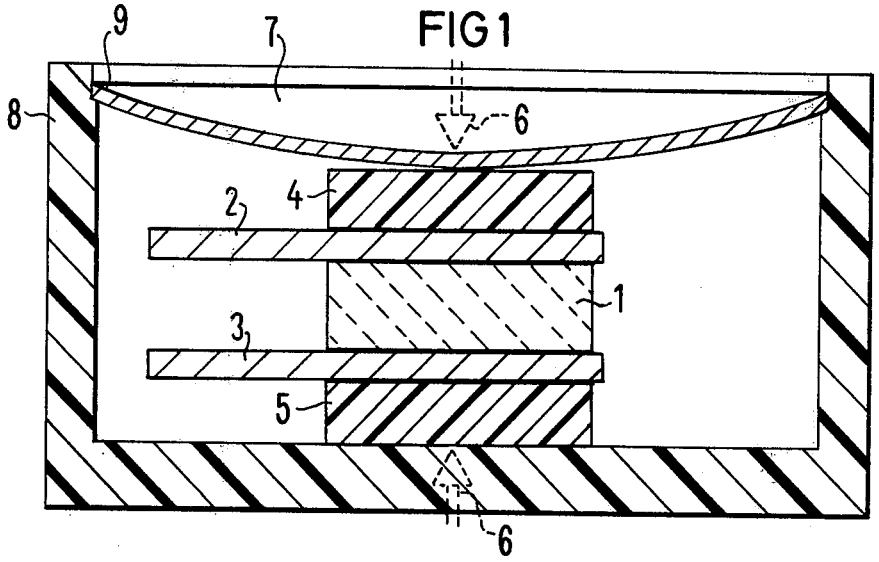
FIG. 1 is a sectional view illustrating a first embodiment of a heating device constructed in accordance with the present invention.

Referring to FIG. 1, a PTC resistor plate 1 is provided in a laminae structure of laminae 2 and 3 which comprise relatively ductile aluminum having a thickness of, for example, 0.5 mm. Insulating bodies 4, 5 provided electrical insulation but, nonetheless, good heat transfer are provided and comprise, for example, aluminum oxide. The contact pressure existing in the built-in state is indicated by a pair of arrows 6 and is provided by a spring 7 force-fit into a housing 8 as indicated at 9. A completely sufficient, good electrical contact is formed between the adjacent surfaces of the PTC resistor plate 1, on the one hand, and the laminae 2 and 3, on the other hand, under the permanent pressure bearing on the entire device. As illustrated in FIG. 1, the laminae 2 and 3 can be constructed to extend outwardly as terminal lugs for the current supply.

Figure 2:
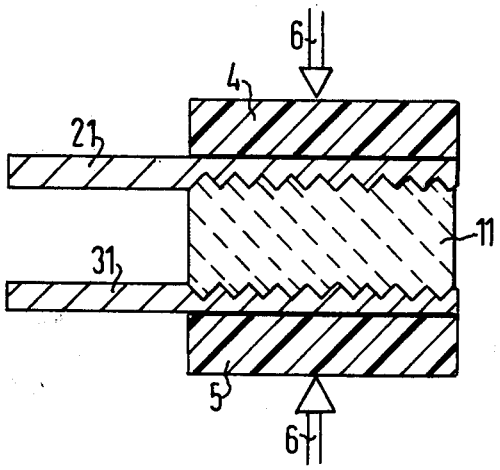
FIG. 2 is a sectional view illustrating a second embodiment of a heating device constructed in accordance with the present invention.

FIG. 2 illustrates another embodiments of the invention in which the PTC resistor plate 11 has a roughening of its surfaces, as schematically illustrated. A measure of between 50 and 100 $\mu$m is particularly suited for the roughness. The laminae of ductile metal are referenced 21 and 31, the laminae receiving an impressed surface under the existing pressure 6 in accordance with the roughness of the PTC resistor plate 11. Such a roughened surface is obtained by employing a forming punch in the pressing of these bodies before the conventional sintering operation. This engagement of the laminae 21 and 31 with the PTC resistor plate 11 occurring due to the roughness leads to a further improvement of the electrical contact.

Figure 3:
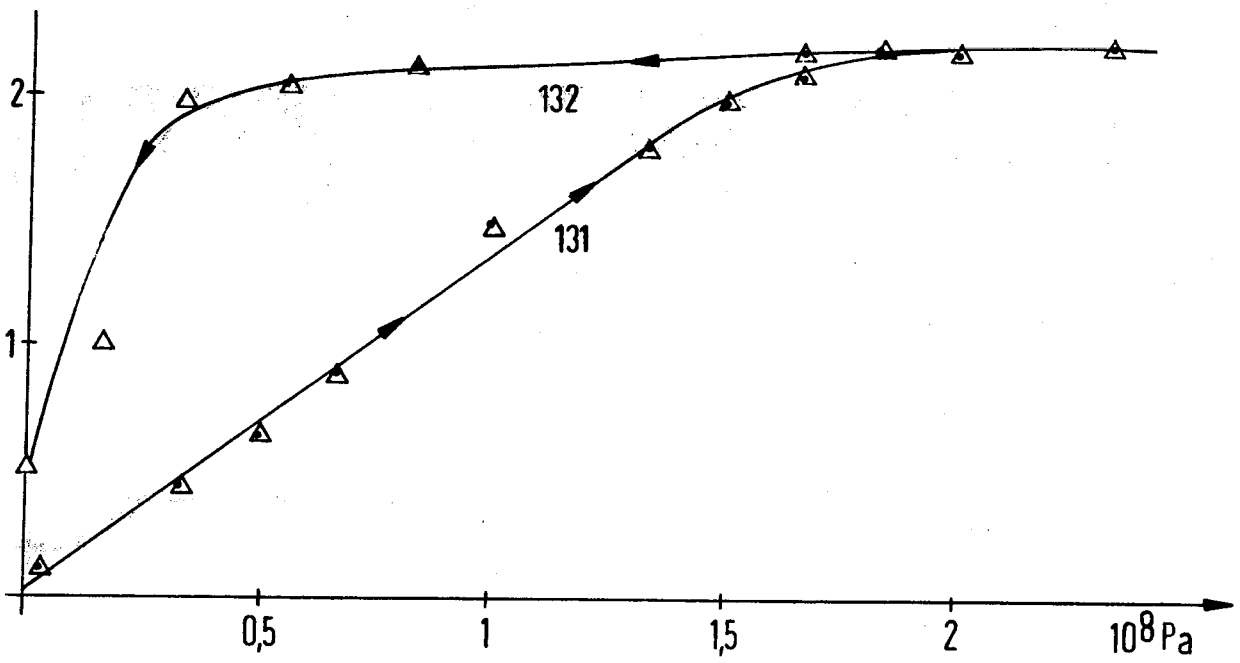
FIG. 3 is a graphic illustration of the pressure-dependent contact employed in practicing the present invention.

FIG. 3 illustrates behavior of an electrical contact between the laminae and the non-metallized PTC resistor plate which exists in accordance with a heating device constructed in accordance with the present invention. The mechanical contact pressure is indicated on the abscissa of the graphical presentation of FIG. 3 and the electrical current consumed (given constant terminal voltage) is indicated on the ordinate. The initial curve 131 shows that a good electrical contact is only achieved given a relatively high pressure of at least $1.3\times10^8$ Pa. This fact fundamentally discourages one skilled in the art from employing PTC resistor plates without metalization for heating devices with, as always required, high electrical current.

Surprisingly, however, it has been shown that, according to the curve 132, a certain hysteresis phenomenon exists. Given pressure of $0.3\times10^8$ Pa, which is still relatively much lower, a good electrical contact always still exists after a one-time exertion of high pressure.

What is important to the present invention is that the surface-wide permanent pressure is retained over the entire useful life of the heating device. In practice, this can be achieved in that the housing or, respectively, the receptacle into which the heating device or, respectively, the heating element is inserted under pressure has a corresponding, permanent elasticity. Such an effect is achieved, for example, by employing a Belleville spring washer in the form of a disc which can, at the same time, be designed as a support mount damped into the housing. Care must be taken that identically good dissipation exists on both sides of the disc.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A heating device comprising:

a positive temperature coefficient resistor plate including a pair of opposite surfaces;

a pair of ductile metal layers contacting respective ones of said opposite surfaces, said electrodes not being unitary parts of the PTC resistor plate; and means urging said ductile metal layers against the respective surfaces at a permanent pressure of at least $0.3\times10^8$ Pa, each of said ductile metal layers constituting a current supply electrode and including a respective electrical terminal.

2. The heating device of claim 1, wherein:

each of said ductile metal layers comprises aluminum.

3. The heating device of claim 1, wherein:

each of said surfaces of said resistor plate has a surface roughness in the magnitude of 100 $\mu$m.

4. A heating device comprising:

a positive temperature coefficient resistor plate including a pair of opposite surfaces, each of said surfaces having a roughness in the magnitude of 100 $\mu$m;

a pair of ductile aluminum layers, each constituting a current supply electrode and including a respective electrical terminal and each contacting respective ones of said opposite surfaces, said electrodes not being unitary parts of the PTC resistor plate; and means urging said aluminum layers against the respective surfaces at a permanent pressure of at least $0.3\times10^8$ Pa.

5. The heating device of claim 4, wherein said means urging said aluminum layers against respective surfaces comprises:

a housing; and spring means clamping the layered structure within and against said housing.

6. The heating device of claim 5, and further comprising:

a pair of insulating layers respectively disposed between an aluminum layer and said housing and said spring means.

* * * * *